US007461435B2

(12) United States Patent
Brown

(10) Patent No.: US 7,461,435 B2
(45) Date of Patent: Dec. 9, 2008

(54) WATER HEATER RESTRAINT

(75) Inventor: Larry D. Brown, San Diego, CA (US)

(73) Assignee: Securus Inc., San Marcos, CA (US)

( * ) Notice: Subject to any disclaimer, the term of this patent is extended or adjusted under 35 U.S.C. 154(b) by 283 days.

(21) Appl. No.: 11/191,503

(22) Filed: Jul. 28, 2005

(65) Prior Publication Data

US 2006/0021201 A1 Feb. 2, 2006

Related U.S. Application Data

(60) Provisional application No. 60/592,028, filed on Jul. 29, 2004.

(51) Int. Cl.
*A44B 11/00* (2006.01)

(52) U.S. Cl. ..... 24/200; 24/193; 24/197

(58) Field of Classification Search ..... None
See application file for complete search history.

(56) References Cited

U.S. PATENT DOCUMENTS 4,484,379 A * 11/1984 Appelt et al. ..... 24/197
7,103,942 B2 * 9/2006 Youngberg ..... 24/171

* cited by examiner

*Primary Examiner*—Jack W. Lavinder
(74) *Attorney, Agent, or Firm*—Stetina Brunda Garred & Brucker

(57) ABSTRACT

A water heater restraint has brackets and a buckle to allow a flexible strap to hold a water heater to a support. The bracket has two slots separated by a bar with one end of the strap threaded through the slots to form a loop encircling the bar so that friction or stitching holds the loop from unthreading. A buckle has two similar slots separated by a bar all located on a spring tang with access occurring through a slot in a base plate, so that when the bar is moved toward the base plate the strap is bound between the base plate and the spring tang to restrain motion of the strap. A projection on either the spring tang or on a sidewall extension of the base plate provides a releasable locking mechanism to lock the spring tang in position and lock the strap against movement.

18 Claims, 13 Drawing Sheets

52
42
44a
44b
36
38
52
46
41

50
42
52
48

42
52
52

38
40
36

52
48
42
50

52
44b
46
48

52
44a
42
36
38
52
48

42
46
44b
44a
41

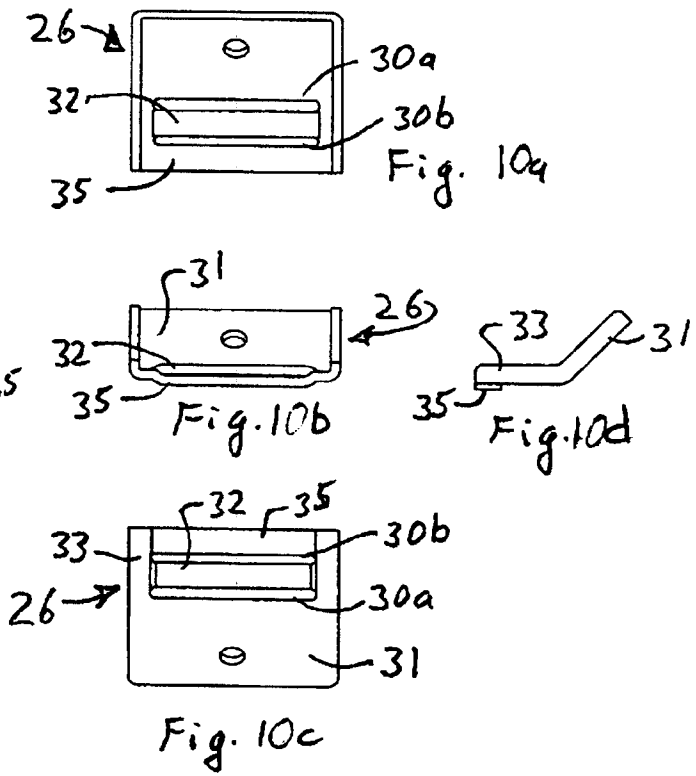
Fig. 10a
Fig. 10b
Fig. 10c
Fig. 10d
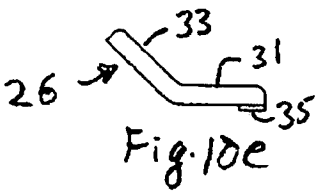
Fig. 10e
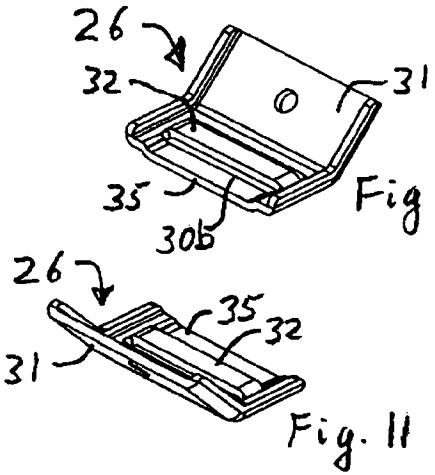
Fig. 11a
Fig. 11b 31
42
44a
44b
46
48
50
52
33
41
38
40

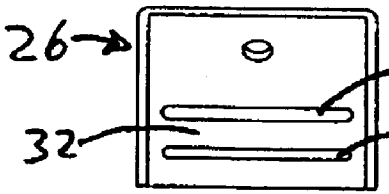
Fig. 14a
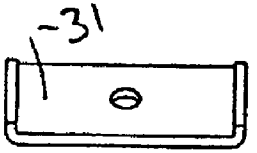
Fig. 14b
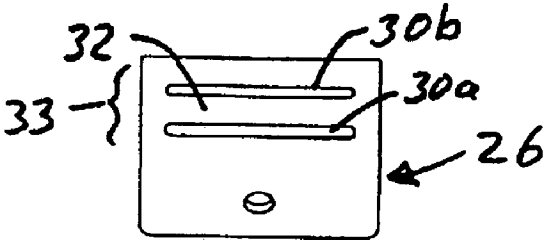
Fig. 14c
Fig. 14d
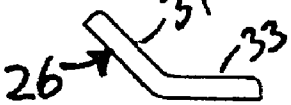
Fig. 14e
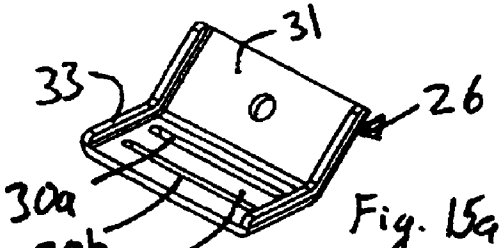
Fig. 15a
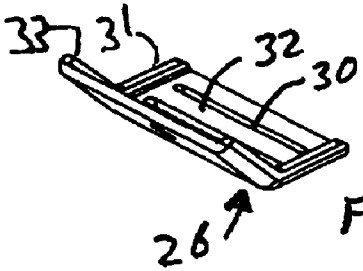
Fig. 15b 34'
52
44a
44b
44a
44b
41
46
42
38
42
41

42
52
52

42
48
50
52
42

40
41
46
44a
38
40
41
46
44a 42
52
52

42
52
46
44a
44b
50
48
42
46
44b
44a

WATER HEATER RESTRAINT

RELATED APPLICATION

This application claims the benefit under 35 U.S.C. § 119 (e), of application Ser. No. 60/592,028, filed Jul. 29, 2004, the entire contents of which are incorporated herein by reference.

BACKGROUND OF THE INVENTION

This invention relates to restraints for water heaters and other containers.

Water heaters and other containers need to be restrained in order to prevent them from tipping over or moving excessively during an earthquake or if they are hit. There is a need to provide a restraint system that is easy to install while allowing fast yet secure adjustment of the restraints.

SUMMARY

A water heater restraint is provided which preferably, but optionally uses a flexible strap, preferably of polyester or other natural or artificial fabric material. One or more end brackets are provided which are fastened to a support structure such as a wall or stud. A single ended buckle can be used to adjust the strap length and tightness. A locking device is provided on the buckle to lock the buckle and fix the strap length. The buckle can be incorporated in to one or more of the brackets if desired. A double ended buckle can also be provided which allows positioning the buckle in order to have the buckle adjacent the water heater, or further away from the water heater.

In more detail, a water heater restraint has brackets and a buckle to allow a flexible strap to hold a water heater to a support. The bracket has two slots separated by a bar with one end of the strap threaded through the slots to form a loop encircling the bar so that friction or stitching holds the loop from unthreading. A buckle has two similar slots separated by a bar all located on a spring tab with access occurring through a slot in a base plate, so that when the bar is moved toward the base plate the strap is bound between the base plate and the spring tab to restrain motion of the strap. A projection on one of the spring tab or a sidewall extension of the base plate provides a releasable locking mechanism to lock the spring tab in position and lock the strap against movement. The loop encircling the bar in the buckle provides a friction lock and the locking tab engaging the spring tab provides a second, positive lock to restrain motion of the strap. A similar buckle structure can be provided on one or more brackets, and could be provided on the base plate to provide a double headed buckle to allow positioning of the buckle along the lengths of two separate straps.

There is thus provided an adjustable restraint for a water heater or other equipment, with the restraint including at least a first flexible strap having a first and second end. An integrally formed, single piece buckle is connected to the strap. The buckle has a first portion forming a base plate with a first slot therein and a second portion forming a first tang that extends over the base plate. The first tang is resiliently positioned at an angle with respect to the base plate. The first tang has second and third slots defining and on opposing sides of a first bar. The first bar is located so it overlaps at least part of the first slot. The first end of the first strap extends along an outer surface of the base plate, through the first, second and third slots to encircle the first bar and then exit along the outer surface of the base plate with that first end of the first strap interposed between the base plate and a portion of the first strap. The first bar is moved toward the first slot as a tension load on the second end of the first strap increases. That movement helps lock the strap to the buckle.

In further variations, at least one side plate extends from the base plate and toward the first tang with the side plate located adjacent an edge of the first tang. The side plate optionally has a locking projection extending toward the first tang a distance sufficient that the first tang can engage the locking projection. The locking projection being located sufficiently close to the base plate so the first tang can be urged toward the base plate when the first strap encircles the first bar such that e the first tang can be interposed between the base plate and the locking projection and held in that position by the locking projection.

In further detail, the buckle clamps the strap as follows. The second slot is located closer to the juncture of the first tang and the base plate than is the third slot. The first bar is offset from the first slot so that the first strap is pinched between the first bar and edges of the base plate defining the first slot and a portion of the first strap is urged toward the first bar. That helps clamp the strap. Advantageously, the first bar is offset from the first slot so the first strap bends when passing through the third and fourth slots.

Advantageously, the first tang is bent over the base plate, and preferably, but optionally, the first tang is resiliently urged away from the base plate, preferably by the bend. Preferably, the first tang is bent over the base plate at a first bend and the cross sectional area at the first bend is less than the cross sectional area adjacent the first slot, the reduced cross-sectional area affecting the bending resistance of the first tang toward the base plate. The reduction in cross-sectional area can be achieved by placing notches in opposing edges of the bend, or by placing a slot in the bend that does not extend to the edges of the bend.

Advantageously, there is a strap engaging slot in the base plate with the slot sized to receive either a second strap or the second end of the first strap. The slot is located opposite a juncture of the first base plate and the first tang. Preferably there is a second strap having a first and second end with the first end fastened to the base plate. A second bracket is also provided and fastened to the second end of the second strap. The second bracket has a second, integrally formed and single piece base plate with a seventh slot and a third bar located above that seventh slot. The second strap extends through the seventh slot in the second base plate to encircle the third bar and exit that seventh slot between an exterior surface of the second base plate and a portion of the second strap. The second bracket has an aperture adapted for fastening the bracket to a building, and preferably to a structural support in a building.

The restraint preferably further comprises a piece of equipment held to a building at least in part by the first strap, with the second end of the first strap being fastened to the building. Preferably, but optionally, the strap has a rectangular cross section with a width several times the thickness of the strap.

In a still further embodiment, a second buckle and second strap are provided. The second flexible strap has a first and second end. The second buckle forms an integral, single piece with the first buckle. Thus, the base plate has a first end containing the first slot and has a second end containing a fourth slot. The first end bends to form the second portion. The second portion includes the first tang and contains the second and third slots defining and on opposing sides of the first bar. The second end bends to form a third portion that includes a second tang that extends over the second end of the base plate and that also includes the fourth slot and which is resiliently positioned at an angle with respect to the base plate. The second tang has fifth and sixth slots defining and on opposing sides of a second bar located so the second bar overlaps at least part of the fourth slot in the base plate. The first end of the second strap extends along an outer surface of the base plate, through the fourth, fifth and sixth slots to encircle the second bar and exit along the outer surface of the base plate. The exiting end of the second strap is interposed between the base plate and a portion of the second strap. The second tang being moved toward the fourth slot as a tension load on the first end of the second strap increases.

This second buckle can also optionally include the various features and variations described for the first buckle. These optional features include at least one side plate-extending from the base plate and toward the first and second tangs and located adjacent an edge of at least one of the first and second tangs. Further, the side plate can have a locking projection extending toward the adjacent at least one of the first and second tangs a distance so the adjacent tang can engage the locking projection. The locking projection is located so the second tang adjacent the locking projection can be interposed between the base plate and the locking projection and held in that position by the locking projection.

As with the first buckle, the first and second bars are optionally, but preferably offset from the first and fourth slots, respectively, so that the first strap is pinched between the first bar and edges of the base plate defining the first slot and a portion of the first strap is urged toward the first bar, and so that the second strap is pinched between the second bar and edges of the base plate defining the fourth slot and a portion of the second strap is urged toward the second bar. As with the first buckle, the strap of the second buckle can be fastened to a building to hold various types of equipment, including water heaters.

Fastening the second strap to the building can be achieved with a second bracket as described above. The second bracket is optionally, but preferably integrally formed of a single piece and fastened to the second end of one of the first and second straps. The second bracket has an attaching portion and a base portion inclined to the attaching portion with a seventh and eighth slot in the attaching portion. A third bar further is formed in the attaching portion and is located above and between those seventh and eighth slots. The seventh slot is distal of the eighth slot and away from the base portion of the second bracket. The second strap extends through the eighth slot in the attaching portion and then through the seventh slot to encircle the third bar. The second strap abuts an edge of the seventh slot and exits the seventh slot between an exterior surface on the distal end of the supporting portion and a portion of the second strap. The base portion optionally has an aperture adapted for fastening the bracket to the building, optionally using threaded fasteners such as screws or bolts. Preferably, the first slot on the second buckle has opposing edges defined by a fourth and fifth bar located in a different plane than the third bar, with the third, fourth and fifth bars being offset from a single piece of material.

In a further embodiment there is also provided a restraint for connecting to a strap to hold a piece of equipment. The restraint includes a plate having a first portion located in a first plane and having a first bar formed from and integrally connected to the plate. The first bar is offset from a first side of the plate toward a second side of the plate and offset from the first plane. The plate has a first slot located below the first bar. The first strap has first and second ends, with the first strap forming a loop that encircles the first bar by entering through the first slot from the first side of the plate to abut lower and upper edges of the first bar on one side of the first bar. The first strap then passes over the first bar and over another upper edge of the first bar to exit the first slot while abutting an edge of the first slot. The parts of the strap forming the loop are generally aligned with the first surface of the first portion adjacent the loop.

One preferred variation of this further embodiment has a bracket in which a distal end of the plate forming a second portion that is bent at an angle to the first plane and has a hole therethrough adapted to allow a fastener to pass to fasten the bracket to a structural support. The first bar is also generally parallel to the first plane but offset therefrom by deforming the first bar from the first plane. Moreover, edges of at least one of the first and second portions are bent generally perpendicular to the first plane to form sidewalls.

A second variation of this further embodiment has a distal end of the plate which forms a second portion that is bent backward at a bend toward the second surface of the plate to form a tang, and the first bar is located in the tang and located over a portion of the first slot during use of the bracket. This second variation preferably, but optionally, has the first bar misaligned with the first slot such that the strap is pinched between the first bar and an edge of the first slot and such that a portion of the first strap is urged toward the first bar as the tang approaches the first portion. The bend optionally has a cross-sectional area that is less than the cross-sectional area adjacent the first slot to reduce the resilient force with which the tang is resiliently urged toward the first portion.

In this second variation, the first portion preferably, but optionally has at least one edge bent toward the second portion to form a sidewalls, and a projection extending from the at least one sidewalls a distance sufficient to interfere with movement of the tang. The projection is located to hold the tang in a closed position substantially parallel with the first portion.

Preferably, but optionally, the first portion has a second slot therein, the bracket further includes two distal ends extending from the plate and forming second and third portions each of which is bent at an angle to the first plane at a bend, the first portion having the first bar located therein and the second portion having a second bar therein located to align with the second slot during use. A second strap having third and fourth ends is provided. The second strap forms a second loop that encircles the second bar by entering through the second slot from the first side of the plate and passing over the second bar to engage a lower edge of the bar and two upper edges of the bar, and then exiting the second slot while abutting an exterior edge of the second slot, with the parts of the second strap forming the second loop being generally aligned with the first surface of the first portion adjacent the loop. Advantageously, but optionally, the first bar is misaligned with the first slot such that the first strap is pinched between the first bar and an edge of the first slot and a portion of the first strap is urged toward the first bar as the first tang approaches the first portion, and the second bar is misaligned with the second slot such that the second strap is pinched between the second bar and an edge of the second slot as the second tang approaches the first portion, so that a portion of the second strap is urged toward the second bar as the second tang approaches the first portion.

This second variation can also have at least one of the bends with a cross-sectional area that is less than the cross-sectional area adjacent the first slot to reduce the resilient force with which one of the tangs is resiliently urged toward the first portion. This second variation also preferably, but optionally has at least one edge bent toward the second tang to form sidewalls, and a projection extending from the at least one sidewall a distance sufficient to block movement of the second tang and located to hold the second tang in a closed position substantially parallel with the first portion. The second end-of at least one strap is fastened to a structural support. Preferably, the first and second slots each have at least one straight edge which abuts one of the first and second straps during use, and the first and second bars have opposing, straight edges generally parallel to the at least one straight edge. The first and second ends are preferably opposite each other, but could be angled relative to each other.

There is also provided a method of connecting straps to hold equipment using a bracket. The method comprises fastening a first end of the bracket to a first structural support. The method further includes passing a first end of a first strap through a first slot in the base plate of the bracket. The base plate is integrally formed with a first tang on a second end of the bracket, the tang having a first bar generally aligned with the first slot during use. The first tang is formed into a bend back toward the base plate and toward the first end. The method further includes passing the first end of the first strap over the first bar and back through the first slot, with the first end passing between the first strap and the base plate. The method also includes tensioning the first strap so the first tang moves toward the base plate to a tightened position.

In further variations, the method includes releasably restraining the first tang from moving away from the first tightened position. Moreover, the method can optionally include misaligning the first bar with the first slot to pinch the first strap between the first bar and an edge of the first slot and a portion of the first strap is urged toward the first bar as the first tang approaches the base plate. The step of fastening the first end of the bracket to a structural support can optionally include fastening a first end of a second strap to the bracket and fastening a second end of the second strap to the structural support.

The step of fastening the second end of the second strap to the structural support can optionally include passing that second end of the strap through an attaching portion of a second bracket oriented at an angle to a mounting portion that is fastened to the structural support. The attaching portion has a seventh and eighth slot in the attaching portion and a third bar further formed in the attaching portion and located above and between those seventh and eighth slots. The seventh slot is distal of the eighth slot and away from the base portion of the second bracket. The second strap passes through the eighth slot in the attaching portion and then through the seventh slot to encircle the third bar. The second strap abuts an edge of the seventh slot and exits the seventh slot between an exterior surface on the distal end of the supporting portion and a portion of the second strap.

BRIEF DESCRIPTION OF THE DRAWINGS

FIGS. 10*a*-10*e* are top, front, bottom, left and right side views, respectively, of the bracket of FIG. 2;

FIGS. 11*a*-11*b* are perspective views of the bracket of FIG. 2 taken from upper and lower perspectives;

FIGS. 14*a*-14*e* are top, front, bottom, left and right side views, respectively, of an alternate embodiment of the bracket of FIG. 11;

FIGS. 15*a*-15*b* are perspective views of the bracket of FIG. 14 taken from upper and lower perspectives;

DETAILED DESCRIPTION

Figure 1:
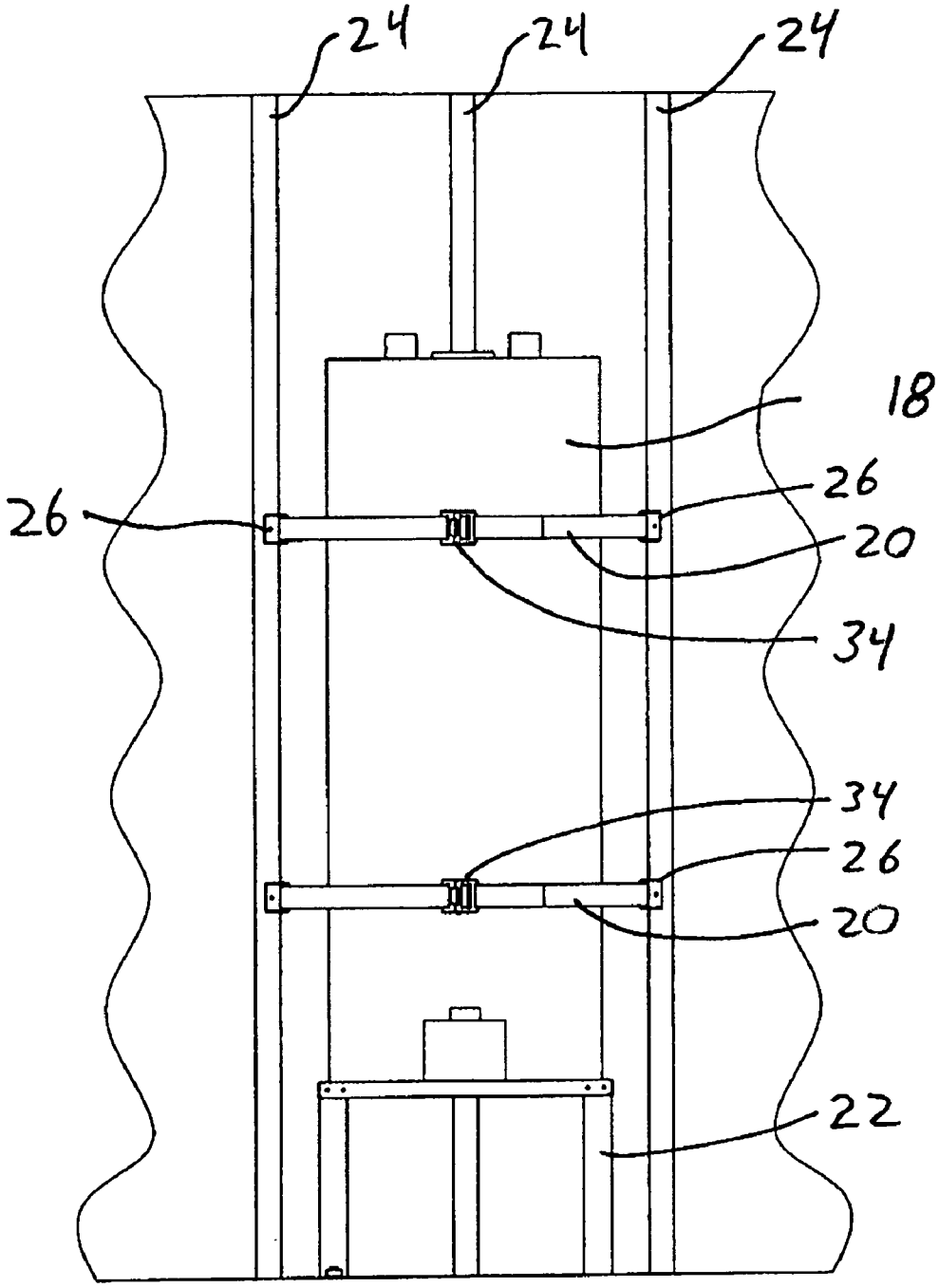
FIG. 1 is a front plan view of a water heater restrained by straps fastened to wall brackets with the strap ends joined by a buckle.

Referring to FIGS. 1-8, a water heater 18 setting on a stand 22 is fastened by straps 20 to a support 24, such as a wall or building stud. The straps 20 may be metal straps, but are preferably made of a flexible material such as Polyester, cotton or other natural or artificial material. The figures show two straps 20 each having one end fastened to a bracket 26 which is in turn fastened to the support 24 by various means known in the art, such as nails, screws, bolts and other fasteners, or by welding, adhesives etc. Preferably the brackets 26 have holes preformed in them to accommodate such fasteners.

Figure 2:
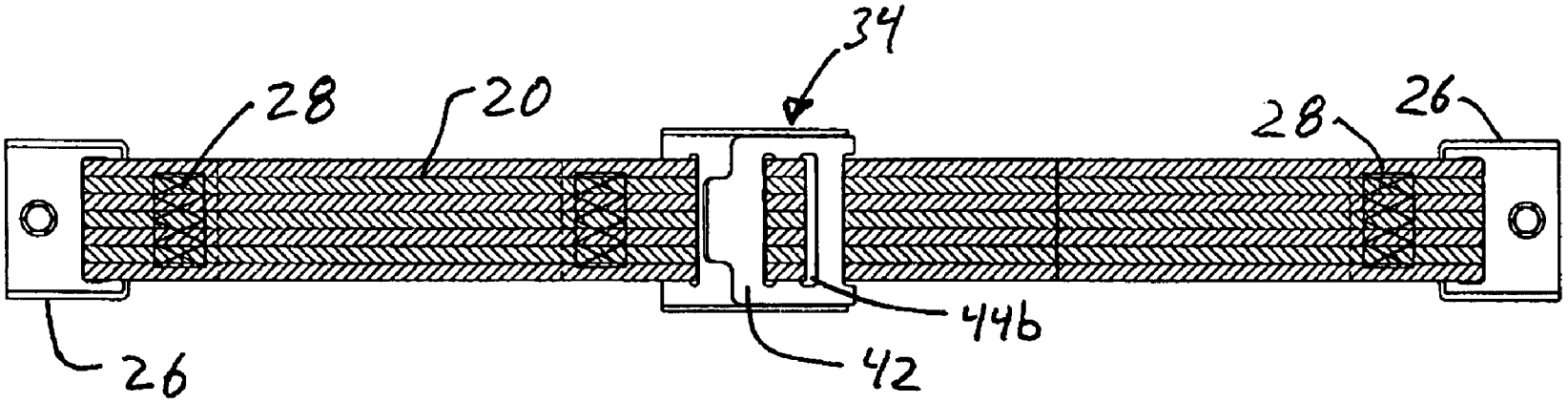
FIG. 2 is a plan view of a strap, buckle and wall bracket.

The straps 20 can be fastened to the brackets 26 by threading an end of the strap through one or more apertures in the bracket to form a loop that encircles a portion of the bracket, and then sewing the loop closed as shown in FIG. 2 with stitching 28, or by using rivets, clamps or other fastening mechanisms. That provides a permanent, non-adjustable connection to the bracket 26. If the strap 20 is a flat strip of material then the aperture in the bracket is preferably sized to accommodate the shape of the strap so an elongated slot would be preferred for the corresponding aperture shape.

Figure 3:
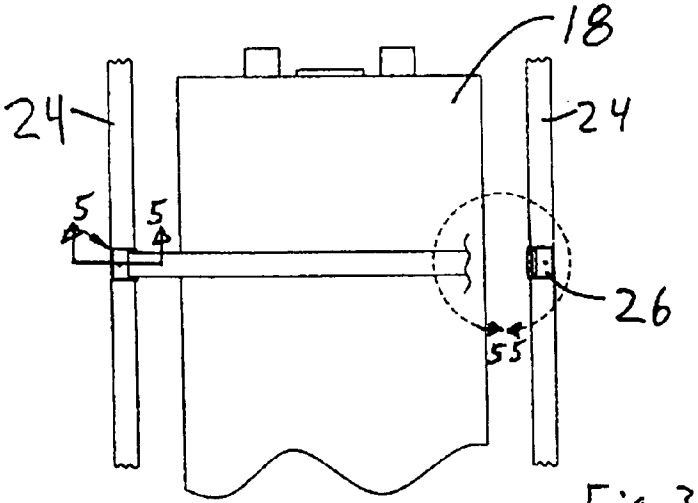
FIG. 3 is a partial plan view of a water heater with a single strap partially encircling the water heater.
Figure 5:
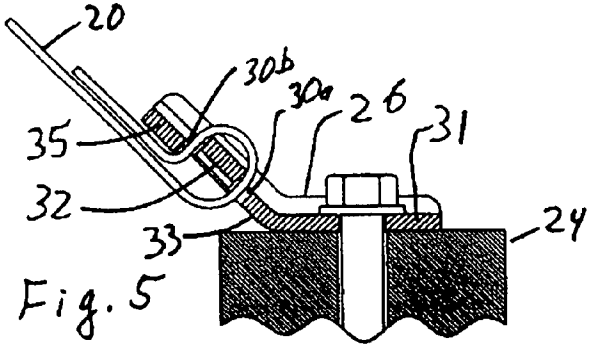
FIG. 5 is a sectional view of a wall bracket and strap taken along section 5-5 of FIG. 4.

Alternatively, as shown in FIGS. 3 and 5, the brackets can have two adjacent openings 30*a*, 30*b*, (preferably slots) and the distal end of the strap can be threaded through the slots to form a loop encircling a bar separating the slots, with the distal end of the strap placed so that friction between the strap and bracket restrain movement of the strap. This allows adjustment of the length of strap 20. In the depicted embodiment the strap 20 threads upward through the slot 30*a* closest to the support 24, passes over the bar 32 separating the slots 30*a*, 30*b*, and then passes downward through the slot 30*b* to exit the bracket across bar 35 and parallel to the strap 20 so as to form a loop encircling the bar 32. As the strap 20 pulls tight, the distal end of the strap is held by friction from unthreading from the slots 30 and the bar 32. In the depicted embodiment of the buckle 26, the bar 32 is offset from the bar 35, with the slot 30*b* separating the two bars 32, 35. But the bars 32, 35 need not be offset and could be in the same plane as the slots 30, as shown in FIGS. 10 and 11. The terms up and down are relative to the orientation of the parts shown in the drawings, as the actual direction will vary with the orientation of the parts as the strap is threaded through them.

The details of the bracket 26 are shown in FIGS. 10*a*-10*c* and 11*a*-11*b*. As seen in FIGS. 10*d*, 10*e* and 11*a*, the bracket 26 is preferably angled so that a base 31 is flat for ease of fastening to the support 24, while the attaching portion 33 extends at an angle of about 30° to 60°, and preferably at an angle of about 45° relative to the base 31. The slots 30 and bar 32 are located in the fastening portion 33. The angled fastening portion 33 extends the slots 30 and bar 32 away from the support 24 and thus allows easier access to thread the strap 20 through the slots 30. Advantageously a flange extends along the edges of the bracket 26 to help strengthen the bracket. Further, if the strap 20 is flat, the flanges help keep the strap aligned with the slots 30*a*, 30*b* in the bracket 26 as the slots are preferably perpendicular to the flanges.

Figure 4:
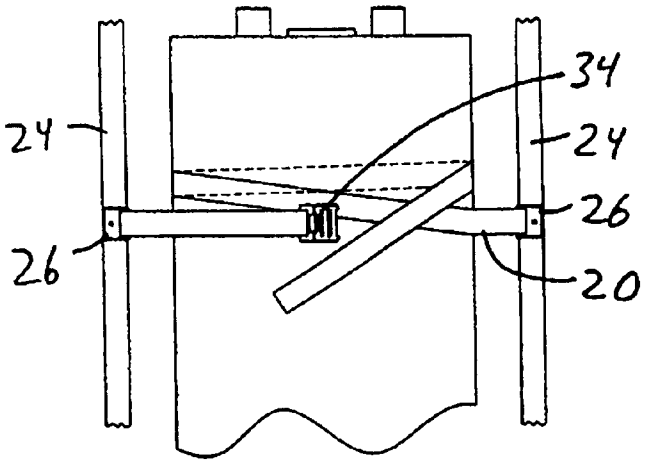
FIG. 4 is a partial plan view of a water heater with a single strap completely encircling the water heater.
Figure 6:
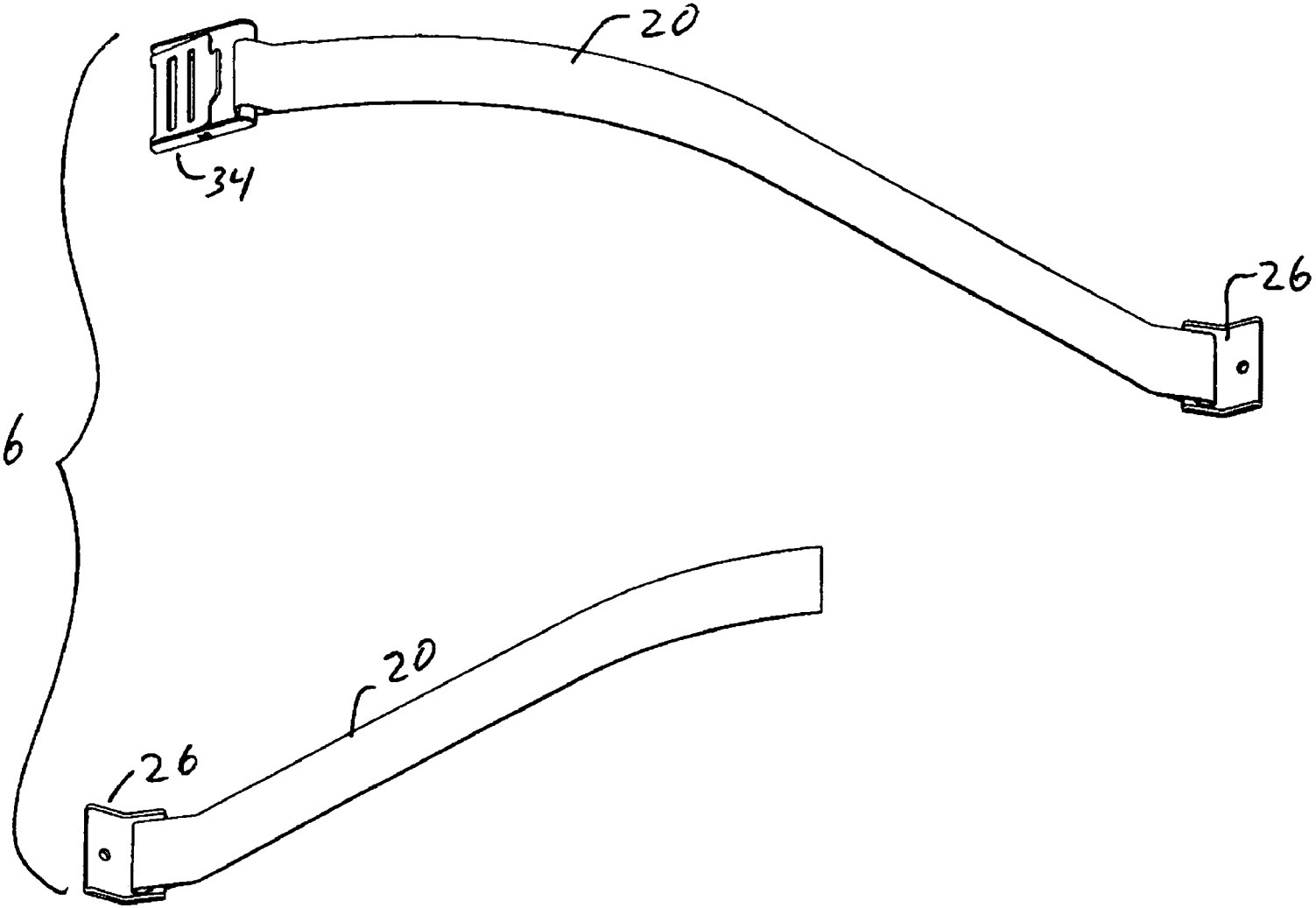
FIG. 6 is a perspective view of two straps connected to two wall brackets and one buckle.
Figures 7A, 7B, 7C:
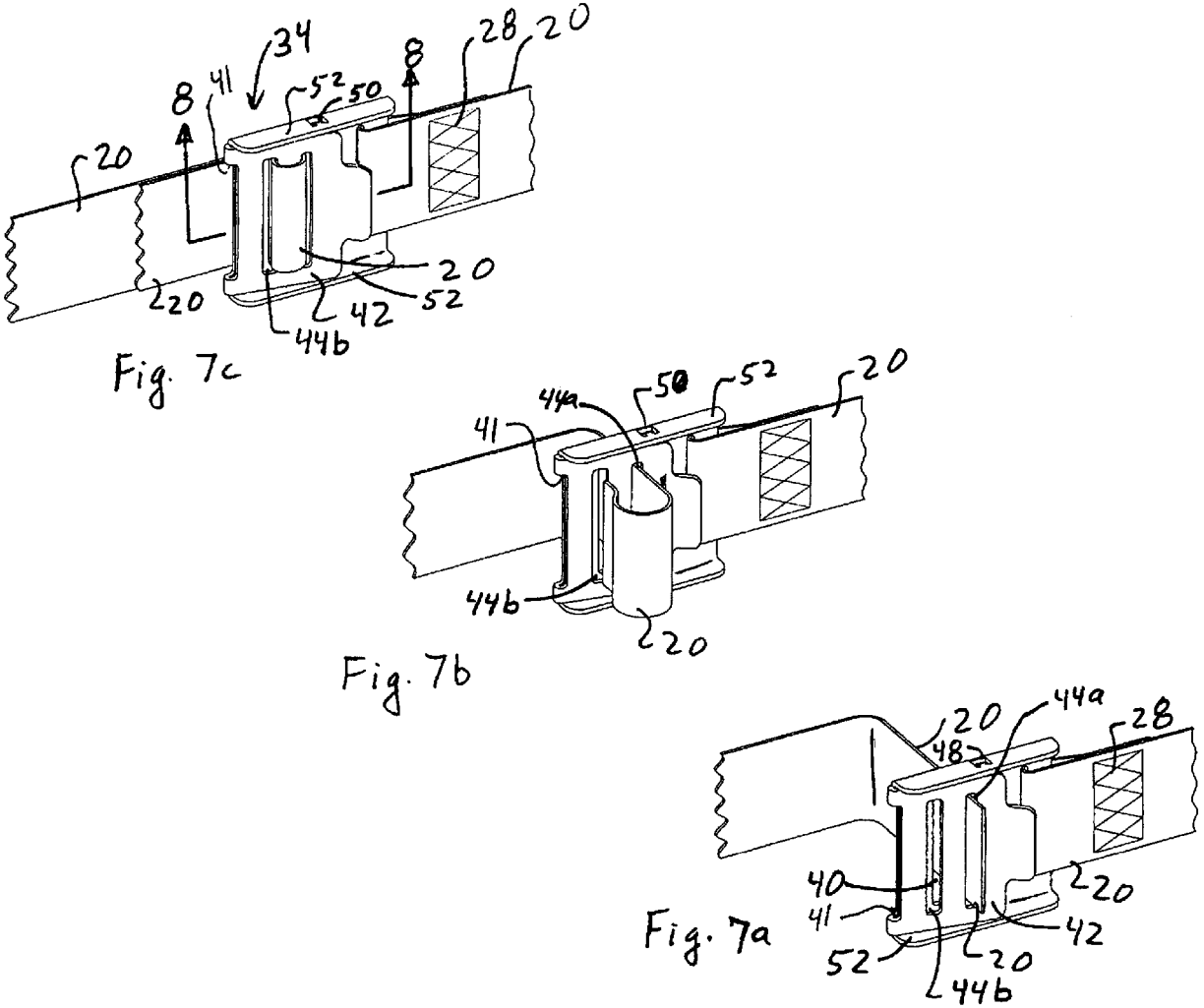
FIG. 7*a*-7*c* are perspective views of the strap of FIG. 2 being threaded through the buckle of FIG. 2.

As shown in FIGS. 1, 2 and 6, one end of each strap 20 is fastened to a bracket 26, with the brackets 26 being fastened to the support 24. The other end of each strap 20 is fastened to a buckle 34. The strap is placed around the water heater 18 and tightened either through the buckle 34 or the adjustable bracket 26, so as to restrain undesirable movement of the water heater. The strap 20 can completely encircle the water heater 18 as shown in FIG. 4, before being fastened to the buckle. Alternatively, the strap 20 can simply abut a portion of the water heater as shown in FIG. 1. Further, the buckle 34 can be omitted and the strap can extend between two brackets 26 as shown in FIG. 3, as long as one of the brackets allows adjustment of the length of the strap 20, as does the adjustable bracket 26 of FIG. 5.

FIGS. 7*a*-7*e* and 8*a*-8*b* show how the ends of the straps 20 fasten to the buckle 34. Preferably one strap 20 has its end passing through a first aperture (e.g., a slot) 36 in the buckle base plate 36 to form a loop which is then sewn closed by stitching 28. That permanently fastens the strap 20 to the buckle 34. The other end of the strap extends through a second aperture 40 in the base plate 38. The second aperture 40 is preferably a rectangular shaped hole. The base plate 38 has a portion bent back on itself and generally parallel to the base plate 38 but at a slight angle to form a tab or tang 42. The tab or tang 42 is preferably, but optionally, resilient enough that it resists being placed flat against the base plate 38, and is instead resiliently urged away from the base plate. Forming a slot 41 at the location of the bend makes it easier to bend the tang 42 into position, and also allows adjustment of the spring force required to bend the tang 42. The longer the length of slot 41 the less material remains joining the spring tang 42 to the base plate 38 and the more flexible is the resilient spring action of the tang 42. The shorter the length of slot 41 the more material is left to join the base plate to the spring tang 42 and that results in a stiffer spring force on the spring tang 42. Between the length and width of slot 41, and the thickness of the material, a variety of spring forces can be achieved. The spring force determines the force with which the locking tabs 48 engage the spring tang 42, and thus helps determine the ease with which the positive lock can be formed and released. This construction applies to all embodiment disclosed herein. While a slot 41 is described, the spring force can also be varied by placing notches in the sides extending toward the middle.

The tang 42 has two parallel apertures or slots 44*a*, 44*b* separated by bar 46. The bar 46 is above the slot 40 in base plate 38 and preferably, but optionally, a portion of slots 44*a*, 44*b* overlap the slot 40. The distal end of the strap 20 passes upward through slot 40 and through the slot 44*a* closest to the distal end of the tang 42. The distal end of the strap 20 then passes over the bar 46 and down through the second slot 44*b* and back through the slot 40 and lays parallel with and against the strap 20. The strap 20 thus forms a loop that encircles the bar 46 above the slot 40. As the strap 20 is pulled tight, the distal end is forced against the base plate 38 and friction restrains loosening of the strap.

The slots 40, 44*a*, 44*b* are preferably elongated openings to accommodate the wide, flat configuration of the strap 20. But the slots 40, 44*a*, 44*b* can have various shapes configured to accommodate the cross-sectional shape of the straps 20, and the meaning of the term "slot" or "aperture" is intended to accommodate those various shapes.

Figure 8A:
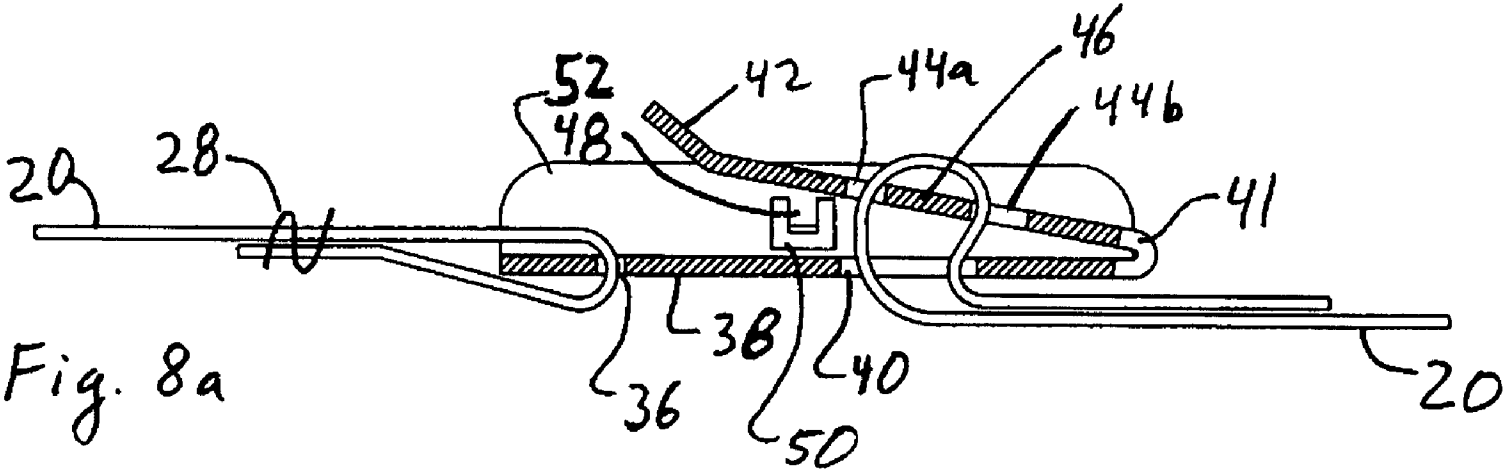
FIGS. 8*a*-8*b* are sectional views taken along section 8-8 of FIG. 7*c;*
Figure 8B:
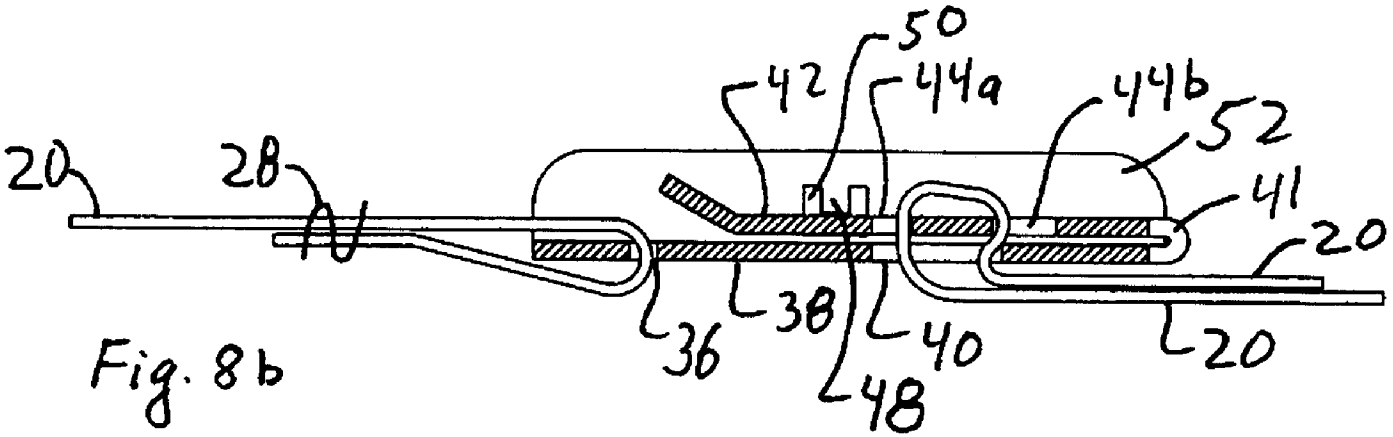
Figures 9A, 9B, 9C, 9D, 9E, 9F, 9G:
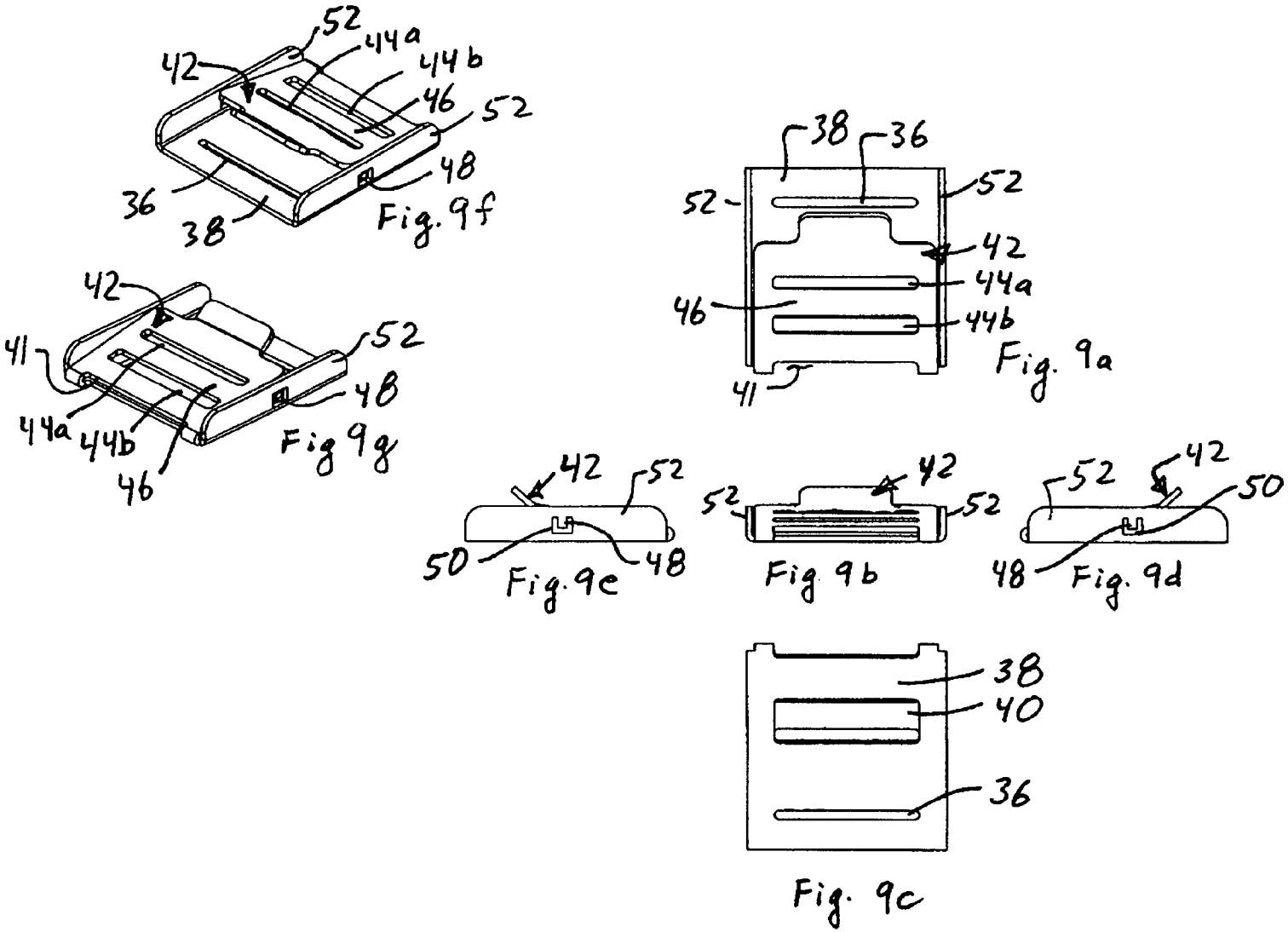
FIGS. 9*a*-9*e* are top, front, bottom, left and right side views, respectively, of the buckle of FIG. 2.
FIGS. 9*f* and 9*g* are perspective views of the buckle of FIG. 2 taken from upper and lower perspectives.
Figure 20:
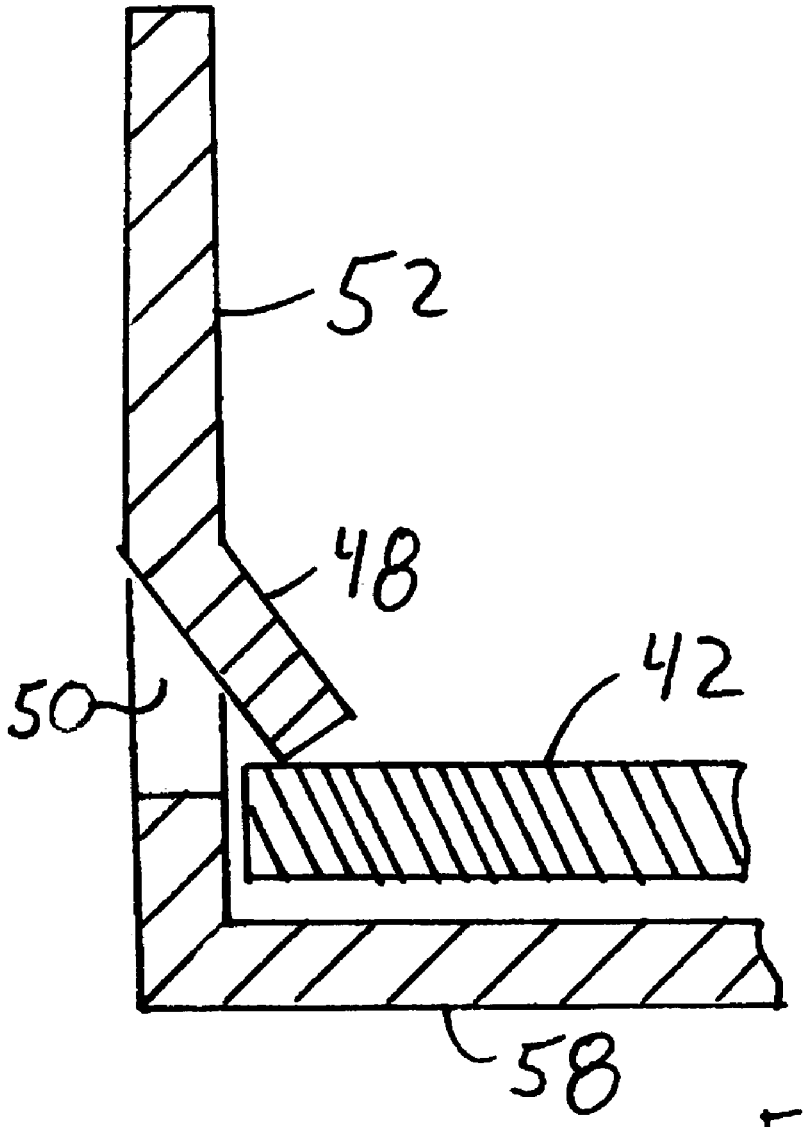
FIG. 20 is a partial sectional view of a locking tab holding a spring tab.

In use, the loop encircling the bar 46 is tightened and the tang 42 is urged toward the base plate. As seen best in FIG. 20, the tang 42 is preferably, but optionally resiliently urged away from the base plate so that the tab or tang 42 applies a resisting force to the tightening loop. Releasable locking tabs 48 extend at an angle laterally away from the sides 52 toward the tang 42 and preferably toward the base plate 38 in order to releasably engage the tang 42 when it is pushed into a position where the tabs 48 can engage it. An aperture 50 surrounds and helps form the locking tab 48. The sides 52 extend generally perpendicular to the base plate 38, and along both sides of the spring tang 42. The spring tang 42 can be manually pushed toward the base plate 38 to engage the locking tabs 48 with the spring tang 42 and thus releasably lock the spring tang 42 in position relative to the base plate 38. As shown in FIG. 8*b*, in the locked position the location of bar 46 is offset from the slot 40, or the overlapping slots 44*b* and 40 are misaligned, such that the edge of the bar or the edges of the slots cause the strap 20 to be pinched between the spring tang 42 and the base plate 38, thus fixing the length of the strap 20. Thus, the strap 20 bends between the bar 46 and base plate 38 in a direction generally parallel to the base plate. The sides 52 of the buckle 34 are resilient, and the locking tabs 48 can thus be disengaged from the mating apertures 50 by bending the sides slightly to disengage the locking tabs 48 from the spring tang 42.

The slots 44*a*, 44*b* and bar 46 on the buckle 34 provide a friction lock for the loop formed in the end of the strap 20 that engages the buckle. The movement of the tang 42 to engage the locking tabs 48 with the tang 42 provides a releasable locking mechanism to ensure the buckle is locked during use, and especially during earthquakes.

The details of construction for the buckle 34 are shown in more detail in FIGS. 9*a*-9*g*. The details of construction for the bracket 26 are shown in more detail in FIGS. 10*a*-10*e* and FIGS. 11*a*-11*b*. The buckle 34 and bracket 26 are preferably made of metal, and can be bent in to the desired shape from rolled metal strips. Metal having a thickness of about 1/16 to 1/8 of an inch is believed suitable, but thinner metal could be used especially if made of steel. The buckle and bracket are advantageously formed of a single piece of metal. Less preferably the buckle and bracket could be cast of metal or even molded of durable plastic of suitable strength and life.

Figures 12A, 12B, 12C, 12D, 12E, 13A, 13B:
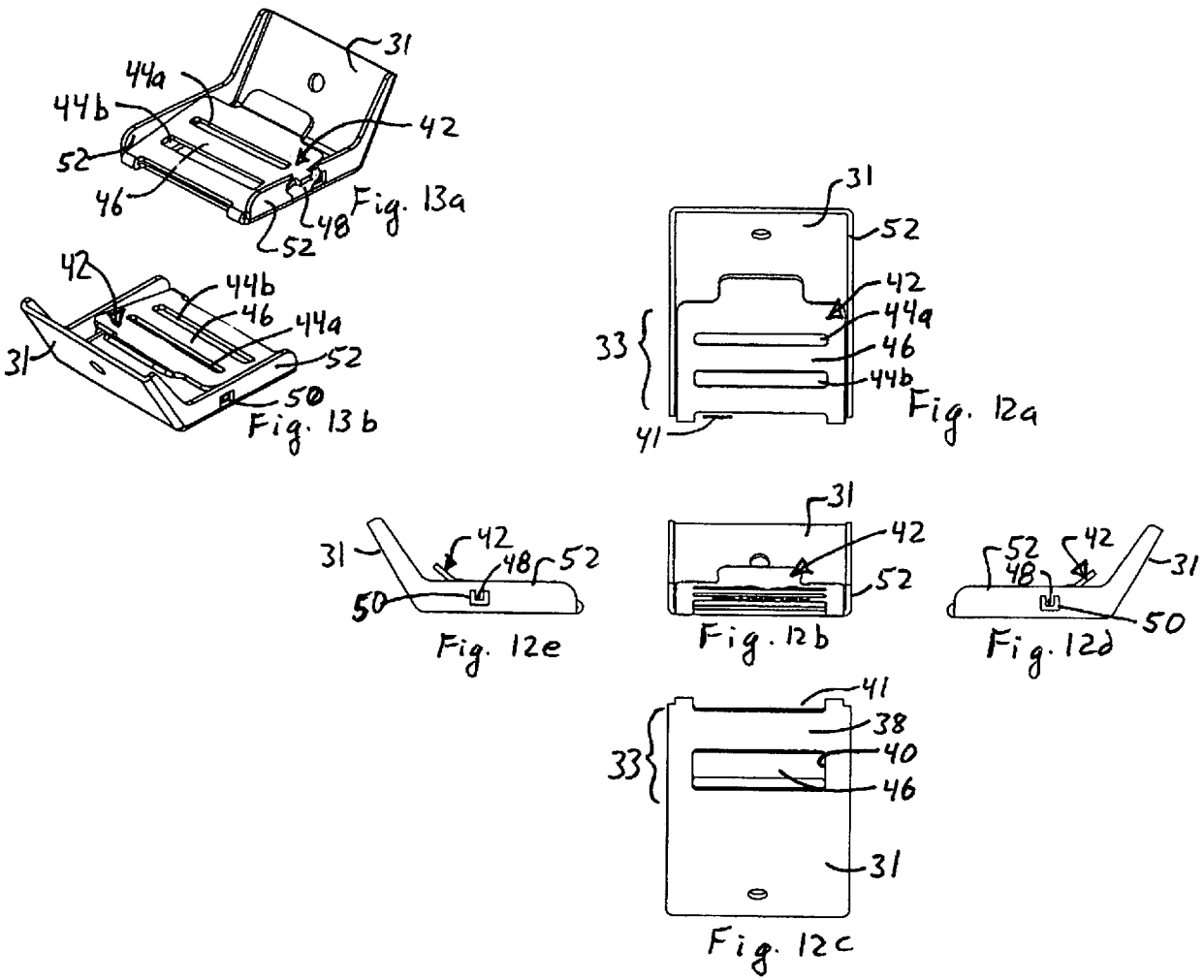
FIGS. 12*a*-12*e* are top, front, bottom, left and right side views, respectively, of an alternate embodiment of the bracket of FIG. 11.
FIGS. 13*a*-13*b* are perspective views of the bracket of FIG. 12 taken from upper and lower perspectives.
Figure 16:
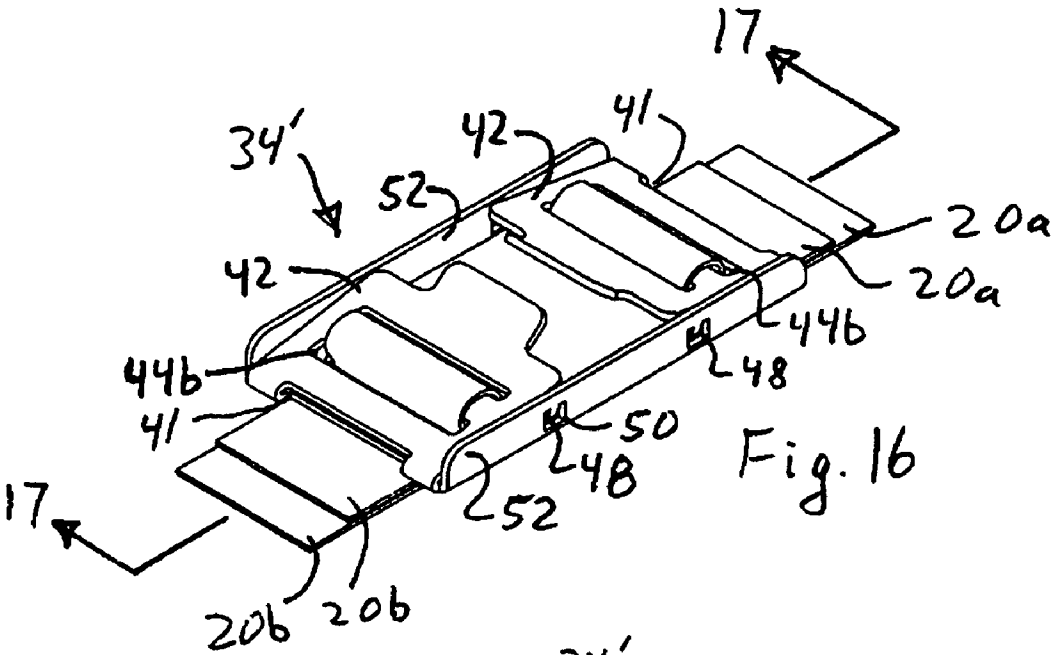
FIG. 16 is a perspective view of an alternative embodiment of the buckle of FIG. 7, having a double ended buckle.
Figure 17:
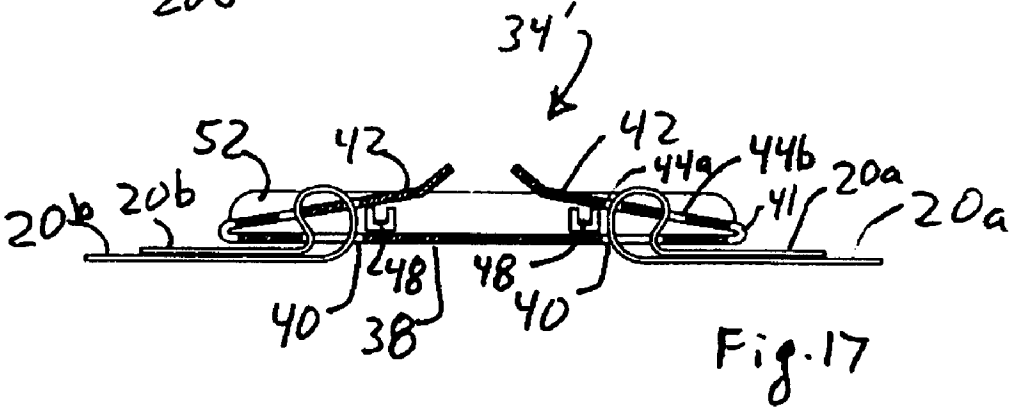
FIG. 17 is a sectional view of the buckle of FIG. 16 taken along section 17-17 of FIG. 16.
Figures 18A, 18B, 18C, 18D, 18E, 19:
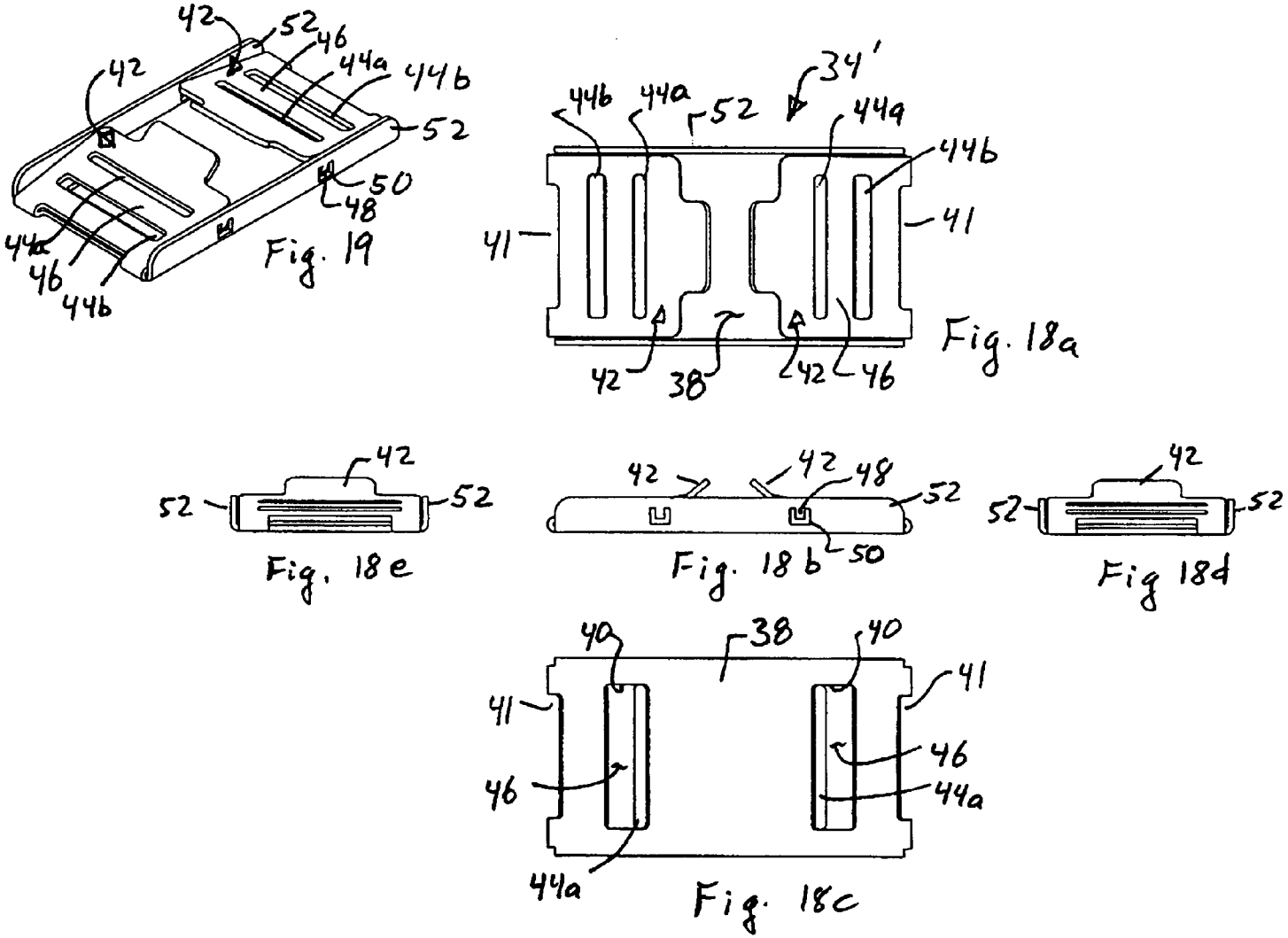
FIGS. 18*a*-18*e* are top, front, bottom, left and right side views, respectively, of the buckle of FIG. 16.
FIG. 19 is a perspective view of the buckle of FIG. 18 taken from an upper perspectives.

Preferably the locking tabs 43 provide a strong engagement with the tang 42 such that a screwdriver is used to disengage the locking tabs 48 from the tang 42, usually by resiliently bending the side walls or flange 52 away from the tang 42. A U shaped aperture 50 is shown with the locking tab 48 extending into that recess, but different shapes of apertures 50 and locking tabs 50 could be used. Further, while locking tabs 48 are shown other spring detent mechanisms or locking mechanisms known to one skilled in the art could also be used. For example, FIG. 13*a* shows a locking tab 48 extending laterally from the tang 42, and it could be configured to engage recess 50. Thus, a detent mechanism is provided that has a projection on one of the parts which are to be locked in relative position, and which has a mating recess on the other of the parts to be locked in relative position.

Referring to FIGS. 12*a*-12*e* and FIGS. 13*a*-13*b*, a further embodiment of the bracket 26 is shown which includes the features of the buckle 34. This modified bracket will be referred to as bracket 26' for ease of reference. The bracket 26' has the same base 31 for fastening the bracket to a support 24 (FIG. 1). The angled attaching portion is modified to have the features of the buckle. Thus, the angled attaching portion 33 has a base plate 38 and an enlarged slot 40 with side flanges or ribs 52 each containing locking apertures 50. The base plate is bent back on itself to form tang 42 which contains parallel slots 44*a*, 44*b* separated by bar 46, and which has locking tabs 48 extending laterally from the side walls 52.

In use, the end of a strap 20 is threaded through the slots 40, 44*a*, 44*b* to form a loop encircling bar 46, and the length of the strap is then adjusted as desired. The tang 42 is then pushed toward the base plate 38 until the locking tabs 48 engage the tang 42 to lock the strap 20 in position relative to the buckle portion of the bracket 26'. The loop formed by the strap 20 and engaging the bar 46 forms a friction lock, and the locking tab 48 engaging the tang 42 forms a second, positive lock.

Referring to FIGS. 16-19, a further embodiment of the buckle 34 is shown in which the buckle 34 is double headed. This further embodiment will be denoted as buckle 34' for ease of reference. The buckle 34' has two tabs 42 with the distal ends of those tabs directed toward each other. The base plate 38 has two slots 40, to accommodate two distal ends of either the same strap 20 or different straps 20. The side walls 52 have two recesses 50 defining two locking tabs 48. The two tabs or tangs 42 are bent back toward the same side of the base plate 38 and each tang has slots 44*a*, 44*b* separated by bar 46. The straps 20 engage the slots 40 and 44 as previously defined.

The double ended buckle 34' allows the buckle to join two straps 20 so that each strap is adjustable, but on the same buckle. It also allows the buckle 34' to be adjustably positioned along the length of the two straps. Thus, if you don't want the buckle 34' to abut the water heater 18, the straps can be adjusted (if long enough) to position the buckle 34' nearer a bracket 26.

Alternatively, the same strap 20 could pass through a slot on one or more (preferably 2) brackets fastened to a support 24 and be held together by the same buckle 34' after completely encircling the water heater 18. A single ended buckle 34 could be used in the same way.

The buckles and brackets disclosed herein provide a wide variety of possible combinations for holding the water heater 18. Thus, a single bracket 26 could be used with a single ended buckle 34 and one or two straps to restrain a water heater 18, but preferably two brackets 26 are used with the buckle 34 and one or two straps (two straps is preferred), as shown in FIGS. 2 and 6. Alternatively, to allow adjustment of both straps, a double ended buckle 34' could be used, or one of the brackets could be made with a buckle as the bracket 26' of FIGS. 12*a*-12*e*, or one of the brackets could be made adjustable as are the brackets of FIGS. 10*a*-10*e* and FIGS. 14*a*-14*e*. Further, a single strap 20 could be used with one or two brackets in any combination of the depicted brackets 26, 26' with or without a buckle 34, 34'. The one undesirable exception is that if the strap 20 is fastened to the bracket by a stitched loop as shown in FIG. 2, then it is preferable to use a buckle 34, 34' in order to allow adjustment of the strap length.

The buckles 34, 34' are shown as having a straight base plate 38, but the base plate could be curved to approximate the curvature of the water heater or other container held by the straps 20.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The buckle 34 is believed to be especially secure when high tension loads are applied to the straps 20. The serpentine path of the strap along the base plate 38, through the slots 40, 44*a*, 44*b* and encircling the bar 46 before exiting along the base plate 38, provide a large friction engagement that does not readily pull loose. Further, once the strap 20 is engaged with the buckle 34, an increase in tension on the straps 20 further tightens the clamping force and further secures the lock formed by the buckle 34. This increased locking force occurs because the strap encircling the bar 46 pulls the tang 42 toward the base, and causes the bar 46 to block the slot 40 in the base 38 through which the strap 20 passes to encircle the bar 46. The bar 46 is preferably sized so that it does not fit through the slot 40 when the strap 20 extends through slot 40 to encircle the bar 46. Indeed, at loads so extreme that the buckle is deformed, the bar 46 begins to bend into the slot 40 in base 38, wedging the bar and straps in the slot 40 to further secure the engagement of the strap with the buckle 34.

Moreover, if the slot 44*b* is not overlapping with the slot 40, then the bar 46 bends in a direction in the plane of the bar 46 and tang 42 as well as bending toward the slot 40, and that requires further force in the strap 20 to achieve that deformation. Thus, if the buckle fails it fails in a safe mode that further wedges the strap 20 and bar 46 toward or into the slot 40 to further secure the strap to the buckle 34. The bending of the bar 46 toward the slot 40 thus provides a failsafe means for securing the strap to the buckle if the forces on the strap exceed the load required to deform the buckle 34. By misaligning the bar 46 so the slot 44*b* does not completely align with the slot 40, and so that the bending of the bar 46 toward the slot 40 and in a direction in the plane of bar 46, provides a further failsafe means for securing the strap to the buckle if the forces on the strap exceed the load required to deform the buckle 34.

The base plate 38 is generally planar, but may be curved to conform to the contour of the object held by the straps 20 and buckle 34. In such cases, the reference to a generally planar base plate 38 is to encompass a curved plane. The straps 20 preferably, but optionally, have a rectangular cross section with a width several times the thickness of the strap.

The configuration of FIGS. 16-19 has two straps 20*a*, 20*b* on opposing ends of the bracket. Three or more straps could be connected to the same base plate. Preferably the straps and the corresponding slots and bars are symmetrically arranged, so if three straps are used, then each strap is aligned at about 120°, if four straps are used they are at about 90°, and so on.

The above description is given by way of example, and not limitation. Given the above disclosure, one skilled in the art could devise variations that are within the scope and spirit of the invention, including various ways of locking the tang 42 in position relative to the base plate 38 to lock the strap 20 in position. As a further example, the embodiment with two tangs 42 has both tangs on the same side of the base 38, but each tang 42 could be located on an opposing side of the base 38. The various features of this invention can be used alone, or in varying combinations with each other and are not intended to be limited to the specific combination described herein. Thus, the invention is not to be limited by the illustrated embodiments but is to be defined by the following claims when read in the broadest reasonable manner to preserve the validity of the claims.

What is claimed is:

1. An adjustable restraint for a water heater or other equipment, comprising:

at least a first flexible strap having a first and second end;

an integrally formed, single piece buckle having a first portion forming a base plate with a first slot therein and a second portion forming a first tang that extends over the base plate and the first slot and is resiliently positioned at an angle with respect to the base plate, the first tang having second and third slots defining and on opposing sides of a first bar located so the first bar overlaps at least part of the first slot, the first end of the first strap extending along an outer surface of the base plate, through the first, second and third slots to encircle the first bar and exit along the outer surface of the base plate with that first end of the first strap interposed between the base plate and a portion of the first strap, the bar being moved toward the first slot as a tension load on the second end of the first strap increases: and at least one side plate extending from the base plate and toward the first tang and located adjacent an edges of the first tang, the side plate having a locking projection extending toward the first tang a distance so the first tang can engage the locking projection, the locking projection being located sufficiently close to the base plate so the first tang can be urged toward the base plate when the first strap encircles the first bar such that the first tang can be interposed between the base plate and the locking projection and held in that position by the locking projection.

2. The restraint of claim 1, wherein the second slot is located closer to the juncture of the first tang and the base plate than is the third slot, and wherein the first bar is offset from the first slot so that the first strap is pinched between the first bar and edges of the base plate defining the first slot and a portion of the first strap is urged toward the first bar.

3. The restraint of claim 1, wherein the third slot is located closer to the juncture of the first tang and the base plate than is the second slot, and wherein the first bar is offset from the first slot so the first strap bends when passing through the third and fourth slots.

4. The restraint of claim 1, wherein the first tang is bent over the base plate.

5. The restraint of claim 1, wherein the first tang is bent over the base plate at a first bend and the cross sectional area at the first bend is less than the cross sectional area adjacent the first slot, the reduced cross-sectional area affecting the bending resistance of the first tang toward the base plate.

6. The restraint of claim 1, wherein the first tang is bent over the base plate at a first bend, and further comprising a slot in the first bend between the base plate and the first tang, the slot in the first bend affecting the bending resistance of the tang toward the base plate.

7. The restraint of claim 1, further comprising a strap engaging slot in the base plate sized to receive one of a second strap or the second end of the first strap and located opposite a juncture of the first base plate and the first tang.

8. The restraint of claim 1, further comprising a piece of equipment held to a building at least in part by the first strap, the second end of the first strap being fastened to the building, the strap having a rectangular cross section with a width several times the thickness of the strap.

9. An adjustable restraint for a water heater or other equipment, comprising:

at least a first flexible strap having a first and second end;

an integrally formed, single piece buckle having a first portion forming a base plate with a first slot therein and a second portion forming a first tang that extends over the base plate and the first slot and is resiliently positioned at an angle with respect to the base plate, the first tang having second and third slots defining and on opposing sides of a first bar located so the first bar overlaps at least part of the first slot, the first end of the first strap extending along an outer surface of the base plate, through the first, second and third slots to encircle the first bar and exit along the outer surface of the base plate with that first end of the first strap interposed between the base plate and a portion of the first strap, the bar being moved toward the first slot as a tension load on the second end of the first strap increases at least one side plate extending from the base plate and toward the first tang and located adjacent an edge of the first tang, a second strap having a first and second end with the first end fastened to the base plate;

a second bracket fastened to the second end of the second strap, the second bracket having a second, integrally formed and single piece base plate with a seventh slot and a third bar located above that seventh slot, the second strap extending through the seventh slot in the second base plate to encircle the third bar and exit that seventh slot between an exterior surface of the second base plate and a portion of the second strap, the second bracket having an aperture adapted for fastening the bracket to a building.

10. The restraint of claim 9, wherein at least one of the second end of the first strap and the second end of the second strap is fastened to a building support.

11. The restraint of claim 9, further comprising at least one side plate-extending from the base plate and toward the first and second tangs and located adjacent an edge of at least one of the first and second tangs.

12. The restraint of claim 9, further comprising at least one side plate-extending from the base plate and toward the first and second tangs and located adjacent an edges of the adjacent at least one of the first and second tangs, the side plate having a locking projection extending toward the adjacent at least one of the first and second tangs a distance so the adjacent tang can engage the locking projection, the locking projection being located sufficiently close to the base plate so the adjacent tang can be urged toward the base plate when the first and second straps encircle the respective one of the first and second bars such that the adjacent tang can be interposed between the base plate and the locking projection and held in that position by the locking projection.

13. The restraint of claim 9, wherein the first and second bars are offset from the first and fourth slots, respectively, so that the first strap is pinched between the first bar and edges of the base plate defining the first slot and a portion of the first strap is urged toward the first bar, and so that the second strap is pinched between the second bar and edges of the base plate defining the fourth slot and a portion of the second strap is urged toward the second bar.

14. The restraint of claim 9, wherein at least one of the second end of the first strap and the second end of the second strap is fastened to a building.

15. The restraint of claim 14, wherein the first slot on the second buckle has opposing edges defined by a fourth and fifth bar located in a different plane than the third bar, the third, fourth and fifth bars being offset from a single piece of material.

16. The restraint of claim 14, further comprising a water heater, with the first and second straps encircling at least a portion of the water, with the second bracket being fastened to a structural support to hold the water heater.

17. The restraint of claim 9, further comprising:

a second bracket integrally formed of a single piece and fastened to the second end of one of the first and second straps, the second bracket having an attaching portion and a base portion inclined to the attaching portion with a seventh and eighth slot in the attaching portion and a third bar further formed in the attaching portion and located above and between those seventh and eighth slots, the seventh slot being distal of the eighth slot and away from the base portion of the second bracket, the second strap extending through the eighth slot in the attaching portion and then through the seventh slot to encircle the third bar, the second strap abutting an edge of the seventh slot and exiting the seventh slot between an exterior surface on the distal end of the supporting portion and a portion of the second strap, the base portion having an aperture adapted for fastening the bracket to a structural support.

18. An adjustable restraint for a water heater or other equipment, comprising:

at least a first flexible strap having a first and second end;

an integrally formed, single piece buckle having a first portion forming a base plate with a first slot therein and a second portion forming a first tang that extends over the base plate and the first slot and is resiliently positioned at an angle with respect to the base plate, the first tang having second and third slots defining and on opposing sides of a first bar located so the first bar overlaps at least part of the first slot, the first end of the first strap extending along an outer surface of the base plate, through the first, second and third slots to encircle the first bar and exit along the outer surface of the base plate with that first end of the first strap interposed between the base plate and a portion of the first strap, the bar being moved toward the first slot as a tension load on the second end of the first strap increases;

at least a second flexible strap having a first and second end; and a second buckle forming an integral, single piece with the first buckle, the base plate having a first end containing the first slot and having a second end containing a fourth slot, the first end bending to form the first second portion comprising the first tang and containing the second and third slots defining and on opposing sides of the first bar, and the second end bending to form a third portion comprising a second tang that extends over the second end of the base plate and the fourth slot and which is resiliently positioned at an angle with respect to the base plate, the second tang having fifth and sixth slots defining and on opposing sides of a second bar located so the second bar overlaps at least part of the fourth slot in the base plate, the first end of the second strap extending along an outer surface of the base plate, through the fourth, fifth and sixth slots to encircle the second bar and exit along the outer surface of the base plate and interposed between the base plate and a portion of the second strap, the second tang being moved toward the fourth slot as a tension load on the first end of the second strap increases.

* * * * *